US011754236B2

(12) United States Patent
Ruan et al.

(10) Patent No.: US 11,754,236 B2
(45) Date of Patent: Sep. 12, 2023

(54) RECESSED LED LAMP WITH SPRING MOUNTING STRUCTURE

(71) Applicant: CH LIGHTING TECHNOLOGY CO., LTD., Shaoxing (CN)

(72) Inventors: Wenqin Ruan, Shaoxing (CN); Jizhong Pu, Shaoxing (CN); Zegang Hang, Shaoxing (CN)

(73) Assignee: CH LIGHTING TECHNOLOGY CO., LTD., Shaoxing (CN)

( * ) Notice: Subject to any disclaimer, the term of this patent is extended or adjusted under 35 U.S.C. 154(b) by 0 days.

(21) Appl. No.: 17/712,083

(22) Filed: Apr. 2, 2022

(65) Prior Publication Data

US 2022/0325858 A1 Oct. 13, 2022

(30) Foreign Application Priority Data

Apr. 6, 2021 (CN) ..... 202120697118.X
Feb. 24, 2022 (CN) ..... 202220384383.7

(51) Int. Cl.

| | |
|---|---|
| ***F21S 8/02*** | (2006.01) |
| ***F21V 17/12*** | (2006.01) |
| ***F21V 19/00*** | (2006.01) |
| ***F21V 17/10*** | (2006.01) |
| *F21Y 115/10* | (2016.01) |

(52) U.S. Cl.

CPC ..... *F21S 8/026* (2013.01); *F21V 17/101* (2013.01); *F21V 17/12* (2013.01); *F21V 19/004* (2013.01); *F21Y 2115/10* (2016.08)

(58) Field of Classification Search

CPC ..... F21S 8/026; F21S 8/02; F21V 21/042; F21V 21/044; F21V 21/04; F21V 21/041; F21V 21/049

See application file for complete search history.

(56) References Cited

U.S. PATENT DOCUMENTS

| | | | | |
|---|---|---|---|---|
| 8,182,116 | B2 * | 5/2012 | Zhang | F21V 29/763 362/249.02 |
| 9,010,956 | B1 * | 4/2015 | Davis | F21V 29/77 362/147 |
| 9,820,350 | B2 * | 11/2017 | Pyshos | F21V 17/12 |
| 9,933,144 | B2 * | 4/2018 | Mandy | F21V 21/046 |
| 10,290,265 | B2 * | 5/2019 | Kumar | F21V 23/009 |
| 10,584,864 | B2 * | 3/2020 | Blake | F21S 8/026 |
| 10,616,969 | B2 * | 4/2020 | Bowen | F21S 8/026 |
| 10,733,944 | B2 * | 8/2020 | Kumar | F21V 23/0442 |
| 11,085,598 | B2 * | 8/2021 | Ward | F21V 33/0056 |
| 11,543,106 | B2 * | 1/2023 | Eberhardt | F21V 21/13 |
| 2009/0147517 | A1 * | 6/2009 | Li | F21V 29/75 362/249.02 |
| 2016/0061421 | A1 * | 3/2016 | Winters | F21V 29/70 362/310 |
| 2021/0325028 | A1 * | 10/2021 | Huang | F21S 8/026 |

* cited by examiner

*Primary Examiner* — Ismael Negron

(57) ABSTRACT

A recessed lamp which includes a surface ring defining a light exit opening, a diffusing plate, and a light emitting assembly. The surface ring has an inner side surface, an outer side surface, and a protruding ring arranged on the inner side surface to surround the light exiting opening. The diffusing plate is positioned to abut against the inner side of the surface ring to cover the light exiting opening, and is fusion sealed to the surface ring. The light emitting assembly includes a plurality of LED lamp beads arranged on a substrate to emit light towards the light exiting opening.

10 Claims, 6 Drawing Sheets

RECESSED LED LAMP WITH SPRING MOUNTING STRUCTURE

CROSS REFERENCE OF RELATED APPLICATIONS

The present application claims priority of Chinese Utility Model Application No. 202120697118.X, filed on Apr. 6, 2021, and Chinese Utility Model Application No. 202220384383.7 filed on Feb. 24, 2022, the entire contents of which are hereby incorporated by reference.

TECHNICAL FIELD

The present disclosure relates to the field of lamps, and particularly to a recessed lamp and a mounting structure thereof.

BACKGROUND

An LED recessed lamp is a hidden luminaire which can be embedded inside a ceiling, and generally includes a housing, and an LED lamp panel and a diffusing plate which are arranged within the housing, wherein light emitted from the LED lamp panel can penetrate the diffusing plate; and the diffusing plate plays a role of uniformly distributing the light, such that the light emitted from the recessed lamp is relatively uniform and soft. Generally, in order to achieve a waterproof effect, a sealing gasket is arranged at a position where the diffusing plate is in contact with the housing. As a result, the whole LED recessed lamp is complicated in structure, and inconvenient to assemble and manufacture.

SUMMARY

The present disclosure provides a recessed lamp and a mounting structure thereof, which is not only capable of achieving a waterproof effect, but also is simple in structure and convenient to manufacture.

The recessed lamp includes:

- a surface ring, provided with a light exiting opening and having an inner side surface and an outer side surface, wherein a protruding ring surrounding the light exiting opening is provided on the inner side surface;
- a diffusing plate, abutting against the surface ring to cover the light exiting opening, and being fusion sealed to the surface ring; and
- a light emitting assembly, including a substrate and LED lamp beads arranged on the substrate to emit light towards the light exiting port.

A plurality of optional embodiments are provided below, which are not intended to be additional limitations on the above general solution, but are merely further additions or optimizations. On the premise of no technical or logical contradiction, the optional embodiments may be combined with the above general solution independently, and may be combined each other there among.

Optionally, the substrate abuts against an end surface of the protruding ring.

Optionally, an inner side surface of the protruding ring is provided with a plurality of threaded tubes, and the substrate is fixed via screws which pass through and are connected with the threaded tubes.

Optionally, the diffusing plate has avoiding grooves for avoiding the threaded tubes.

Optionally, the diffusing plate abuts against the inner side surface of the surface ring, the recessed lamp further comprises a reflecting cup in a shape of a conical cylinder, two ends of the reflecting cup are opened, and the reflecting cup has one end abutting against the substrate and another end abutting against the diffusing plate.

Optionally, the recessed lamp further includes spring fasteners, wherein the spring fasteners are mounted on the protruding ring.

Optionally, the inner side surface of the surface ring is provided with a sealing gasket surrounding the protruding ring.

Optionally, the inner side surface of the surface ring has an ultrasonic welding line extending along a circumferential direction of the surface ring.

Optionally, the diffusing plate has an edge portion resting on the surface ring and a middle portion protruding therefrom and extending into the light exiting opening, and the edge portion and the middle portion form a positioning step engaged with the light exiting opening.

The present disclosure further provides another recessed lamp, including:

- a surface ring, provided with a light exiting opening and having an outer side surface and an inner side surface, wherein a protruding ring surrounding the light exiting opening is provided on the inner side surface;
- a diffusing plate, abutting against the surface ring to cover the light exiting opening;
- a light emitting assembly, comprising a substrate and LED lamp beads arranged on the substrate to emit light towards the light exiting opening; and
- a decorating panel, covering on the outer side surface and provided with a through hole which has a size corresponding to a size of the light exiting opening.

Optionally, a peripheral edge of the decorating panel has a protruding ring enclosing the side surface of the surface ring.

Optionally, an edge of the decorating panel is provided with snap hooks which are bent to abut against the inner side surface of the surface ring.

The present disclosure further provides a mounting structure of a recessed lamp, including a support with an mounting surface and a recessed lamp, wherein the recessed lamp comprises a surface ring with a light exiting opening, a diffusing plate abutting against the surface ring to cover the light exiting opening and a light emitting assembly; the light emitting assembly comprises a substrate and LED lamp beads arranged on the substrate to emit light towards the light exiting opening; the mounting surface is provided with a mounting hole, and a local portion of the recessed lamp extends into an interior of the mounting hole; and wherein the surface ring has an outer side surface and an inner side surface, and the inner side surface abuts against the mounting surface.

Optionally, a sealing gasket is arranged between the inner side surface and the mounting surface.

Optionally, the surface ring is fusion sealed to the diffusing plate.

The diffusing plate and the surface ring of the recessed lamp of the present disclosure are fixed by means of ultrasonic welding, and portions where the diffusing plate and the surface ring are connected can be in fusion seal by means of the ultrasonic welding, such that the portions where the diffusing plate and the surface ring are connected are sealed and fixed, which can make a light exiting surface of the recessed lamp reach the IP65 waterproof level.

Figure 1:
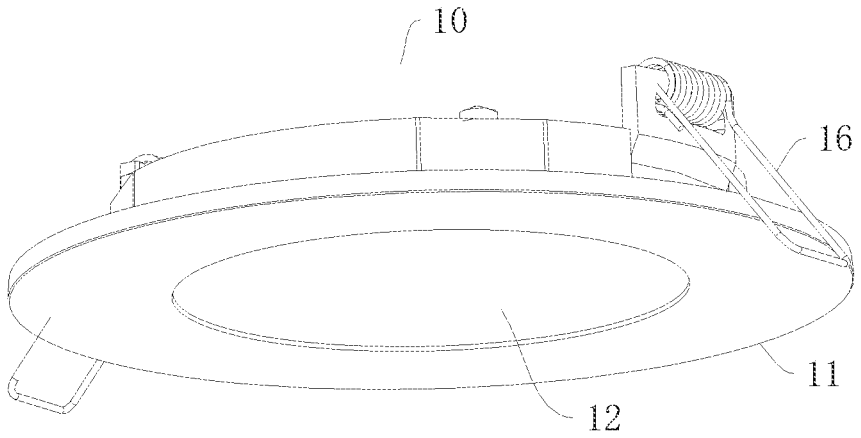
FIG. 1 is a structural schematic view of a recessed lamp according to an embodiment of the present disclosure.

Reference numerals in the drawings are explained below: 10, recessed lamp; 11, surface ring; 111, inner side surface; 112, outer side surface; 113, light exiting opening; 114, protruding ring; 115, threaded tube; 116, screw; 12, diffusing plate; 121, avoiding groove; 122, positioning step; 13, light emitting assembly; 131, substrate; 132, LED lamp bead; 14, sealing gasket; 15, reflecting cup; 16, spring fastener; 17, ultrasonic rib; 18, decorating panel; 180, through hole; 181, protruding ring; 182, snap hook; 19, threading hole; 20, driving power supply; 21, pulling-resistant joint; 22, clamping block; 23, diameter-reducing portion; 30, mounting surface; and 31, mounting hole.

DESCRIPTION OF THE EMBODIMENTS

Technical solutions in embodiments of the present disclosure will be clearly and completely described below with reference to accompanying drawings in the embodiments of the present disclosure. It should be understood that the described embodiments are only a part of the embodiments, but not all of the embodiments of the present disclosure. Based on the embodiments in the present disclosure, all other embodiments obtained by those ordinarily skilled in the art without creative efforts shall fall within the protection scope of the present disclosure.

It should be noted that when an assembly is referred to as being "connected" to another assembly, it may be directly connected to another assembly or an intervening assembly may exist. When an assembly is considered to be "arranged on" another assembly, it may be directly arranged on another assembly or an intervening assembly may exist.

Unless otherwise defined, all technical and scientific terms used herein have the same meaning as commonly understood by those ordinarily skilled in the technical field to which the present disclosure belongs. The terms used herein in the specification of the present disclosure are for the purpose of describing specific embodiments only, and are not intended to limit the present disclosure. As used herein, the term "and/or" includes any and all combinations of one or more of the associated listed items.

Figure 2:
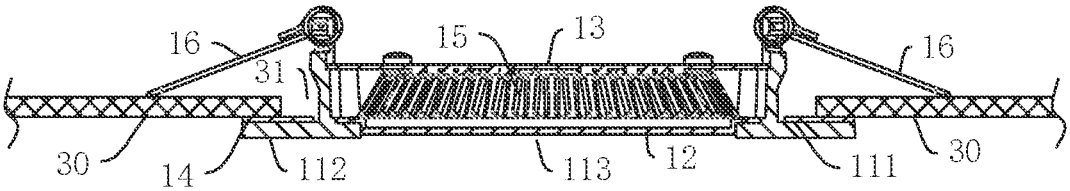
FIG. 2 is a structural schematic view showing the recessed lamp shown in FIG. 1 mounted on a ceiling.
Figure 3:
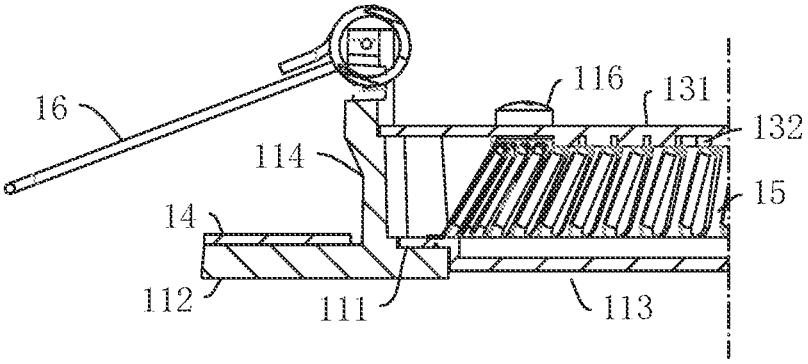
FIG. 3 is a partial cross-sectional view of the recessed lamp in FIG. 1.

As shown in FIG. 1 to FIG. 3, the present disclosure provides a recessed lamp 10, which includes a surface ring 11, a diffusing plate 12 and a light emitting assembly 13. The surface ring 11 has an inner side surface 111 and an outer side surface 112 which are opposite to each other, and is provided with a light exiting opening 113 in its center position. The diffusing plate 12 abuts against the inner side surface 111 of the surface ring 11 to seal and cover the light exiting opening 113, and the light emitting assembly 13 includes a substrate 131 and LED lamp beads 132 arranged on the substrate 131 to emit light towards the light exiting opening 113.

The recessed lamp 10 forms a light exiting surface at the light exiting opening 113. When the recessed lamp 10 is mounted on a ceiling, a light exiting surface of the recessed lamp 10 is exposed to the outside. Since the diffusing plate 12 abuts against the inner side surface 111 of the surface ring 11, a gap will exist. In a case where the recessed lamp 10 is in a humid environment or an environment that is prone to splashing water, water will enter the interior of the recessed lamp 10 from the gap. In order to make the light exiting surface of the recessed lamp 10 have a waterproof function, in one embodiment, as shown in FIG. 2 and FIG. 3, the diffusing plate 12 and the surface ring 11 are fixed by means of ultrasonic welding, and a portion where the diffusing plate 12 is in contact with the surface ring 11 is welded by means of the ultrasonic welding, such that the portions where the diffusing plate 12 and the surface ring 11 are connected are fixed in a sealing manner. In this way, the light exiting surface of the recessed lamp 10 may achieve a certain waterproof function. In this embodiment, the recessed lamp 10 may reach the IP65 waterproof level in its front face.

It is appreciated that the diffusing plate 12 may be in fusion seal against the outer side surface 112 of the surface ring 11. Similarly, the same waterproof level may be achieved.

In this embodiment, the diffusing plate 12 and the surface ring 11 are made of plastic. Particularly, the surface ring 11 is made of white PC, which is light-resistant and flame-retardant, and has a flame-retardant level reaching the V0 level. The diffusing plate 12 is made of light-diffusing milky white PC having a flame-retardant level reaching the V2 level and passing a 125-degree ball pressure test.

Figure 4:
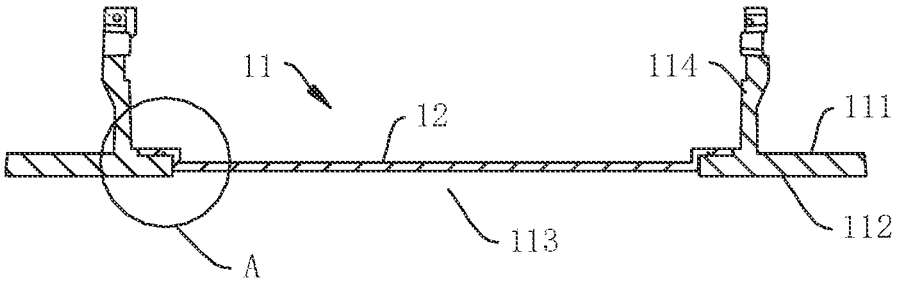
FIG. 4 is a structural schematic view showing a surface ring and a diffusing plate in FIG. 1.
Figure 5:
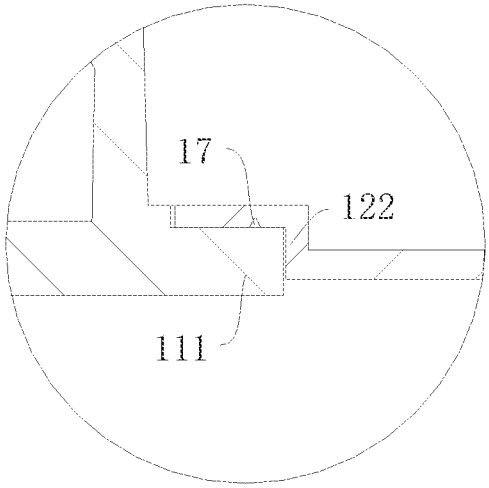
FIG. 5 is an enlarged schematic view showing a structure of a portion A in FIG. 4.
Figure 6:
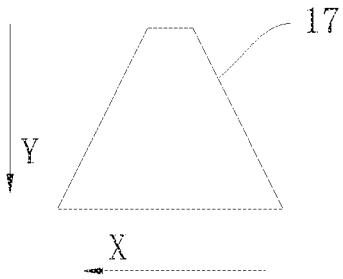
FIG. 6 is a structural schematic view showing an ultrasonic rib in FIG. 5.

In order to facilitate the ultrasonic welding of the diffusing plate 12 and the surface ring 11, reference is made to one of the embodiments. As shown in FIG. 4 to FIG. 6, the inner side surface 111 of the surface ring 11 has an ultrasonic rib 17 extending along a circumferential direction of the surface ring. The ultrasonic rib 17 is located at a position where the surface ring 11 is in contact with the diffusing plate 12. In this embodiment, the ultrasonic wire 17 is arranged in a closed loop, and the surface ring 11 and the diffusing plate 12 achieve a 360-degree waterproof effect after being subjected to the ultrasonic welding.

In order to avoid the problem of glue overflow during ultrasonic welding of the surface ring 11 and the diffusing plate 12, in this embodiment, along a radial direction of the surface ring 11, the ultrasonic rib 17 is located in the middle of a region where the surface ring 11 is in contact with the diffusing plate 12. Regarding the specific setting of the ultrasonic rib 17, reference is made to one of the embodiments. The ultrasonic rib 17 has a width (in the X direction in FIG. 6) ranging from 1 mm to 2 mm, a height (in the Y direction in FIG. 6) ranging from 1 mm to 2 mm, and a trapezoidal cross section. In this embodiment, the ultrasonic rib 17 has a width of 1.5 mm and a height of 1.2 mm.

In order to ensure accurate positioning of the surface ring 11 and the diffusing plate 12 during the ultrasonic welding, reference is made to one of the embodiments. As shown in FIG. 3, the diffusing plate 12 has an edge region resting on the surface ring 11 and a middle portion protruding therefrom and extending into the light exiting opening 113. A positioning step 122 is formed between the edge region and the middle portion, as such, the diffusing plate 12 is accurately positioned.

In this embodiment, as shown in FIG. 2 and FIG. 3, the inner side surface 111 of the surface ring 11 has a protruding ring 114 extending inwardly and surrounding the light exiting opening 113. The substrate 131 abuts against and fixedly connected with an end surface of the protruding ring 114, the substrate 131 is corresponding to the protruding ring 114 to form a closed space, and the LED lamp bead 132 is located in the closed space, which may further achieve a waterproof and dustproof effect on the recessed lamp 100. The protruding ring 114 and the surface ring 11 are integrally arranged, which may increase the structural strength between the protruding ring 114 and the surface ring 11, and may reduce the technological difficulty between the protruding ring 114 and the surface ring 11.

Figure 7:
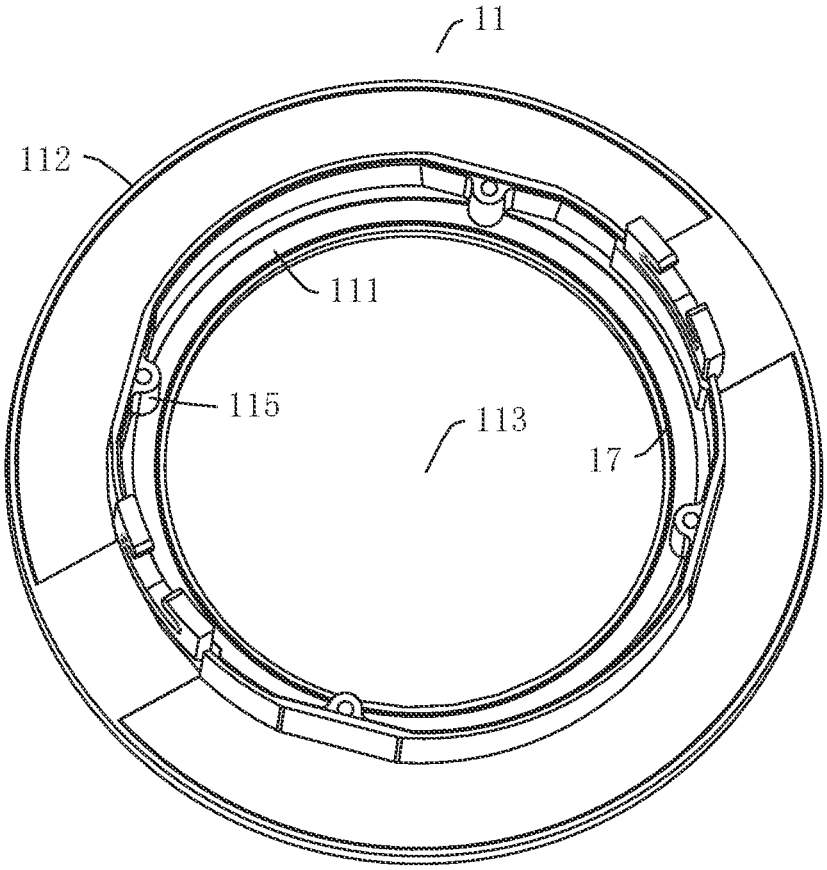
FIG. 7 is a structural schematic view showing a surface ring in FIG. 1.
Figure 8:
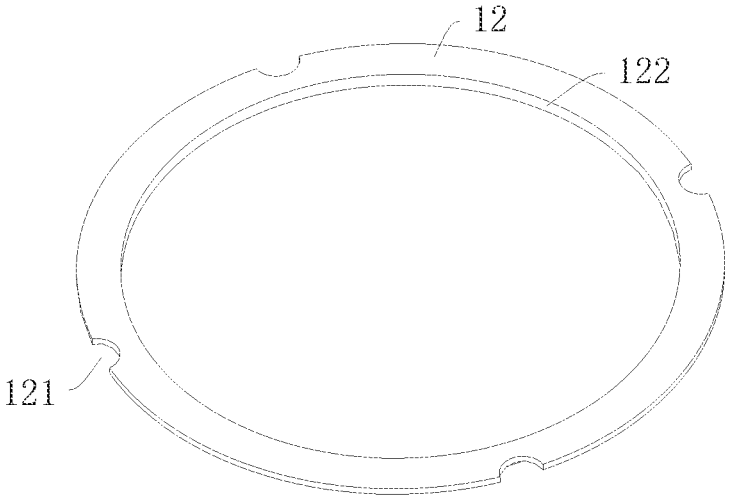
FIG. 8 is a structural schematic view showing a diffusing plate in FIG. 1.

In order to fix the substrate 131 on the protruding ring 114, reference is made to one of the embodiments. As shown in FIG. 2, FIG. 7 and FIG. 8, an inner side of the protruding ring 114 is provided with a plurality of threaded tubes 115, and the substrate 131 is fixed via screws which extend therethrough and connected with the threaded tubes 115. Particularly, each threaded tube 115 is provided with a screw hole, the substrate 131 has through holes, and the screws 116 are engaged with the screw holes respectively after passing through the through holes on the substrate 131. When the screws 116 are screwed within the screwing holes, the substrate 131 may abut against an end portion of the protruding ring 114.

The diffusing plate 12 has avoiding grooves 121 for avoiding the threaded tubes 115. A contour of the avoiding groove 121 is similar to that of the threaded tube 115. When the diffusing plate 12 is mounted on the surface ring 11, the avoiding grooves 121 are fitted with the threaded tubes 115, which may ensure that the diffusing plate 12 is accurately positioned and improve the quality during the ultrasonic welding.

In this embodiment, as shown in FIG. 2 and FIG. 3, the recessed lamp 10 further includes a reflecting cup 15 in a shape of a conical cylinder. Two ends of the reflecting cup 15 are opened, one end of the reflecting cup 15 abuts against the substrate 131 and the other end thereof abuts against the diffusing plate 12. The reflecting cup 15 is located within the protruding ring 114. When the substrate 131 is screwed on the threaded tubes 115 by means of the screws 116, the reflecting cup 15 is tightly sandwiched therebetween (at this time, one end of the reflecting cup 15 abuts against the substrate 131 and the other end thereof abuts against the diffusing plate 12), as such, the reflecting cup 15 can be fixed.

Figure 9:
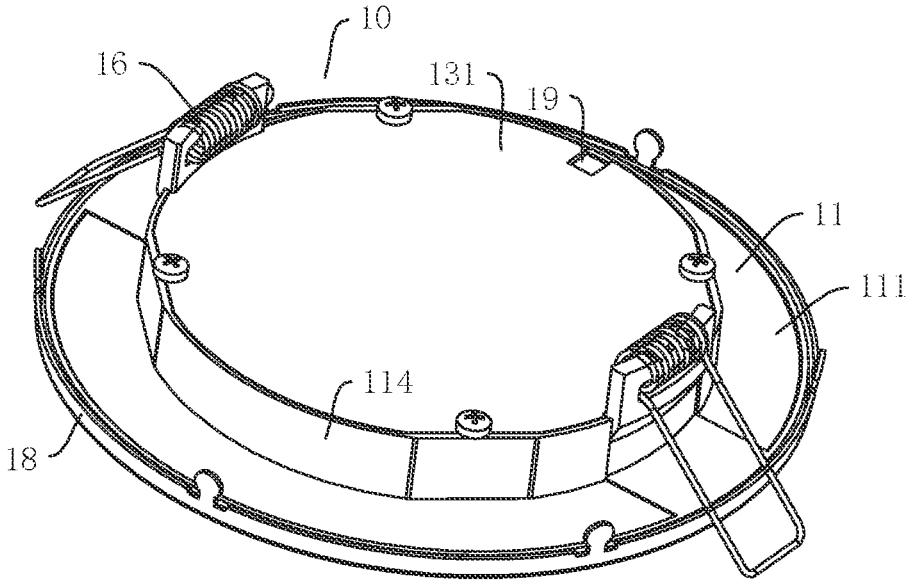
FIG. 9 is a structural schematic view a recessed lamp according to another embodiment of the present disclosure.
Figure 10:
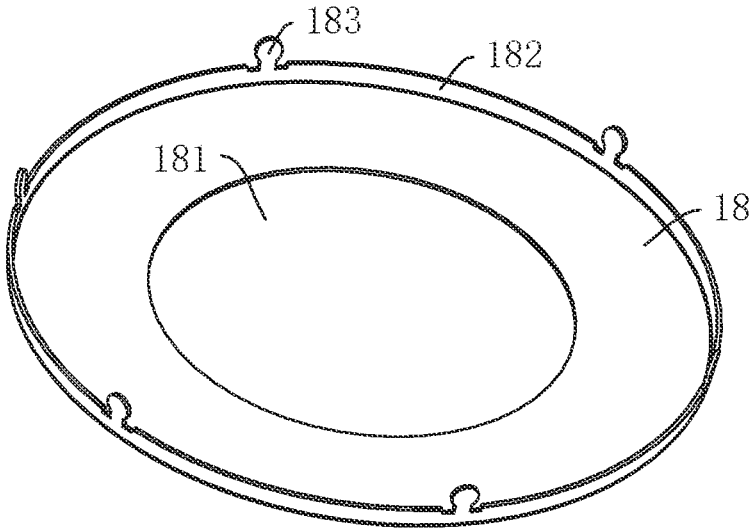
FIG. 10 is a structural schematic view showing a decorating panel in FIG. 9.
Figure 11:
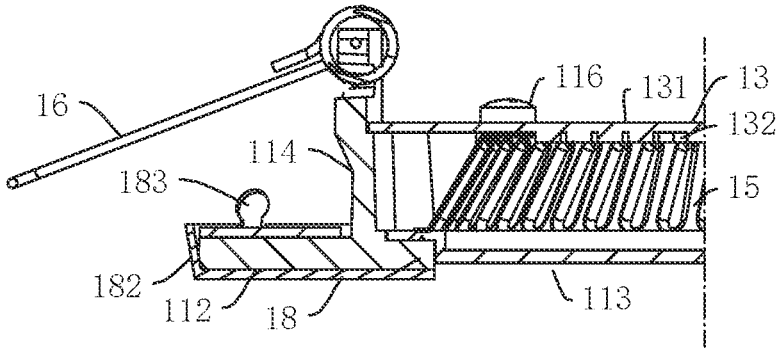
FIG. 11 is a cross-sectional view of the recessed lamp shown in FIG. 9.

As shown in FIG. 9 to FIG. 11, An alternative LED recessed lamp 10 includes a surface ring 11, a diffusing plate 12, a light emitting assembly 13 and a decorating panel 18. The surface ring 11 has an inner side surface 111 and an outer side surface 112, as well as a light exiting opening 113 in its center position. The diffusing plate 12 abuts against the surface ring 11 to cover the light exiting opening 113. The light emitting assembly 13 includes a substrate 131 and LED lamp beads 132 fixed on the substrate 131 to emit light towards the light exiting opening 113. The decorating panel 18 is covered on the outer side surface 112, and provided with a through hole 181 which has a size corresponding to that of the light exiting opening 113. An internal structure and an assembling method of this recessed lamp are the same as those of the above embodiment, which will not be described in detail herein.

The decorating panel 18 of the present disclosure is detachably mounted on the outer side surface 112 of the surface ring 11, and may be replaced at any time as required, which is simple and convenient to operate and attractive in overall appearance.

In one embodiment, a peripheral edge of the decorating panel 18 has a protruding ring 182 enclosing the side surface of the surface ring 11. In order to facilitate the mounting, an edge of the decorating panel 18 is provided with a plurality of snap hooks 183, which are bent inwardly and abut against the inner side surface 111 of the surface ring 11. The number of the snap hooks 183 may be set as required. For the purpose that the snap hooks 83 are not prone to be dropped after being mounted, the snap hooks 83 need to be evenly distributed.

Figure 12:
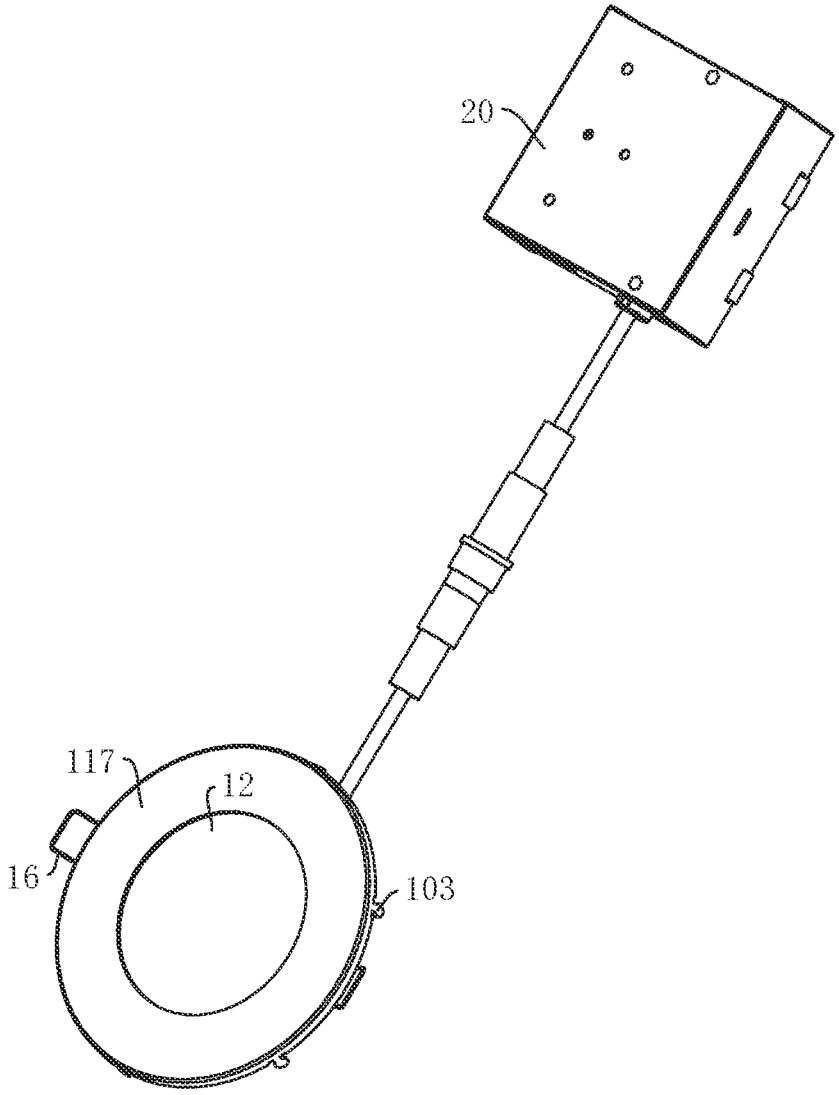
FIG. 12 is a schematic view showing a connection between a recessed lamp of the present disclosure and a driving power supply.
Figure 13:
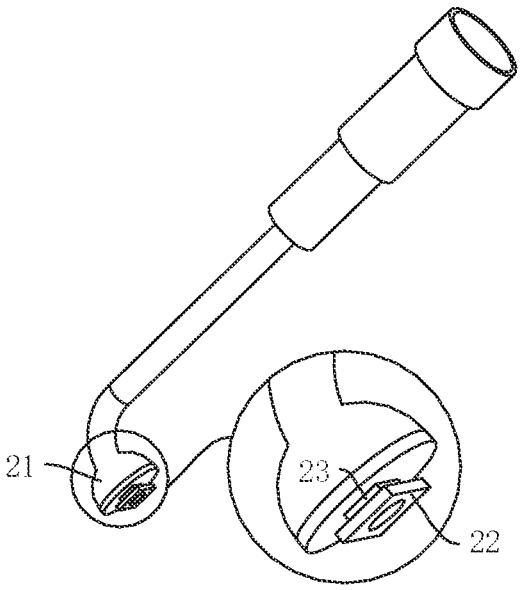
FIG. 13 is a schematic view showing a joint structure of a wire connecting a recessed lamp.

As shown in FIG. 12 and FIG. 13, when the recessed lamp 10 of the present disclosure is used, it needs to be connected with a driving power supply 20, which is required to convert external commercial power into direct current to supply power to the recessed lamp 10. The driving power supply 20 generally includes a driving box and a circuit board arranged inside the driving box. Electronic components are arranged on the circuit board, and the electronic components form a driving circuit for converting alternating current into direct current. The driving power supply 20 is connected to the recessed lamp 10 through a cable. An end portion of the cable is provided with a pulling-resistant joint 21. The substrate 121 is provided with a threading hole 19. The pulling-resistant joint 21 is mounted at the threading hole 19. As shown in FIG. 13, the pulling-resistant joint 21 is of a hemispherical structure, and is provided with a clamping block 22 protruding thereof and passing through the threading hole 19. A diameter reducing portion 23 is arranged between the clamping block and the pulling-resistant joint 21. The clamping block 22 can prevent the joint from being separated from the substrate 131. The cable is fixedly connected with the pulling-resistant joint, such that the cable and the substrate 131 can be prevented from being disconnected.

In case that the recessed lamp 10 is mounted on a ceiling, in some embodiments, as shown in FIG. 2, the recessed lamp 10 further includes spring fasteners 16, wherein the spring fasteners 16 are mounted on the protruding ring 114, and cooperate with the inner side surface 112 of the surface ring 11 to mount the recessed lamp 10 onto the ceiling. At this time, a gap will exist between the inner side surface 112 of the surface ring 11 and the ceiling, through which water may enter the recessed lamp 10. In order to solve this problem, in some embodiments, the inner side surface 112 of the surface ring 11 is provided with a sealing gasket 14. When the recessed lamp 10 is mounted on the ceiling, the sealing gasket 14 on the surface ring 11 abuts against the ceiling.

The sealing gasket 14 is made of waterproof EVA cotton. The waterproof EVA cotton is compressible to some extent along an axial direction of the surface ring when being pressed by the spring fastener 16 and the surface ring 11, so as to be able to achieve a waterproof effect between the surface ring and the ceiling.

As shown in FIG. 1 and FIG. 2, the present disclosure further provides a mounting structure of a recessed lamp. The recessed lamp 10 may be any recessed lamp described in the above embodiments. The mounting structure includes a mounting surface 30 with a mounting hole 31 (in this embodiment, the mounting surface 30 is a lower surface of the ceiling), the recessed lamp 10 extends into the interior of the mounting hole 31, the inner side surface 111 of the surface ring abuts against the mounting surface 30. In order to improve the waterproof effect, the sealing gasket 14 is arranged between the inner side surface 111 of the surface ring and the mounting surface 30.

Technical features of the above embodiments can be combined arbitrarily. In order to make the description concise, all possible combinations of the technical features in the above embodiments are not described. However, the combinations of these technical features should be considered to fall within the range described in this specification provided that no contradiction exists. When the technical features of different embodiments are embodied in the same drawing, it should be considered that this drawing discloses combination examples of the various embodiments involved.

The above embodiments only represent several implementations of the present disclosure, and the descriptions thereof are relatively specific and detailed, but should not be construed as a limitation on the scope of the patent application. It should be noted that for those ordinarily skilled in the art, several modifications and improvements falling within the protection scope of the present disclosure can be made without departing from the concept of the present disclosure.

What is claimed is:

1. A recessed lamp, comprising:

a surface ring, provided with a light exiting opening and having an inner side surface and an outer side surface, wherein a protruding ring surrounding the light exiting opening is provided on the inner side surface;

a diffusing plate, abutting against the surface ring to cover the light exiting opening, and being fusion sealed to the surface ring;

a light emitting assembly, comprising a substrate and LED lamp beads arranged on the substrate to emit light towards the light exiting opening; and wherein the diffusing plate has an edge portion resting on the surface ring and a middle portion protruding therefrom and extending into the light exiting opening, and the edge portion and the middle portion form a positioning step engaged with the light exiting opening.

2. The recessed lamp according to claim 1, wherein the diffusing plate abuts against the inner side surface of the surface ring, the recessed lamp further comprises a reflecting cup in a shape of a conical cylinder, two ends of the reflecting cup are opened, and the reflecting cup has one end abutting against the substrate and another end abutting against the diffusing plate.

3. The recessed lamp according to claim 1, further comprising spring fasteners, wherein the spring fasteners are mounted on the protruding ring.

4. The recessed lamp according to claim 1, wherein the inner side surface of the surface ring is provided with a sealing gasket surrounding the protruding ring.

5. The recessed lamp according to claim 1, wherein the inner side surface of the surface ring has an ultrasonic welding line extending along a circumferential direction of the surface ring.

6. The recessed lamp according to claim 1, wherein the substrate abuts against an end surface of the protruding ring.

7. The recessed lamp according to claim 6, further including:

a plurality of threaded tubes provided on an inner side surface of the protruding ring; and a plurality of screws, wherein the screws pass through and are connected with the threaded tubes to fix the substrate.

8. The recessed lamp according to claim 7, wherein the diffusing plate has avoiding grooves for avoiding the threaded tubes.

9. A recessed lamp, comprising:

a surface ring, provided with a light exiting opening and having an outer side surface and an inner side surface, wherein a protruding ring surrounding the light exiting opening is provided on the inner side surface;

a diffusing plate, abutting against the surface ring to cover the light exiting opening;

a light emitting assembly, comprising a substrate and LED lamp beads arranged on the substrate to emit light towards the light exiting opening;

a decorating panel, covering on the outer side surface and provided with a through hole which has a size corresponding to a size of the light exiting opening; and wherein an edge of the decorating panel is provided with snap hooks which are bent to abut against the inner side surface of the surface ring.

10. The recessed lamp according to claim 9, wherein a peripheral edge of the decorating panel has a protruding ring enclosing the outer side surface of the surface ring.

* * * * *